US006699063B2

(12) United States Patent
Lebender

(10) Patent No.: US 6,699,063 B2
(45) Date of Patent: Mar. 2, 2004

(54) CABLE ASSEMBLY HAVING STRAIN RELIEF MECHANISM AND HOUSING INCORPORATING SUCH CABLE ASSEMBLY

(76) Inventor: Roland Lebender, Reutbergerstr. 15, 91710 Gunzenhausen (DE)

( * ) Notice: Subject to any disclaimer, the term of this patent is extended or adjusted under 35 U.S.C. 154(b) by 0 days.

(21) Appl. No.: 10/094,511

(22) Filed: Mar. 5, 2002

(65) Prior Publication Data

US 2003/0171025 A1 Sep. 11, 2003

(51) Int. Cl.[7] ..... H01R 13/58
(52) U.S. Cl. ..... 439/451; 439/452; 174/152 G
(58) Field of Search ..... 174/152 G, 153 G; 439/451, 452, 455

(56) References Cited

U.S. PATENT DOCUMENTS

| | | | | |
|---|---|---|---|---|
| 3,258,234 A | | 6/1966 | Fernerg | 248/56 |
| 4,758,179 A | | 7/1988 | Klein et al. | 429/497 |
| 4,857,674 A | | 8/1989 | Filbert | 174/135 |
| 4,900,266 A | | 2/1990 | Sainsbury et al. | 439/451 |
| 5,394,592 A | | 3/1995 | Quick | 24/16 R |
| 5,414,218 A | | 5/1995 | Nathan | 174/15.1 |
| 5,742,982 A | | 4/1998 | Dodd et al. | 24/16 R |
| 5,975,924 A | | 11/1999 | Daoud | 439/98 |
| 5,980,298 A | | 11/1999 | Johnson | 439/359 |
| 6,486,400 B1 | * | 11/2002 | Smutny et al. | 174/65 G |

FOREIGN PATENT DOCUMENTS

| | | |
|---|---|---|
| DE | 298 08 030 | 9/1999 |

* cited by examiner

*Primary Examiner*—Khiem Nguyen
(74) *Attorney, Agent, or Firm*—Allan M. Wheatcraft

(57) ABSTRACT

A cable assembly is disclosed which has a cable extending along the cable assembly, and a strength member also extending along the cable assembly. At least one independent anchoring element is attached to one of the member ends of the strength member and has an opening provided therein. The strength member passes through the opening of the independent anchoring element and thus holds the independent anchoring element in place on a casing.

18 Claims, 4 Drawing Sheets

CABLE ASSEMBLY HAVING STRAIN RELIEF MECHANISM AND HOUSING INCORPORATING SUCH CABLE ASSEMBLY

FIELD OF THE INVENTION

The invention relates to a cable assembly having a strain relief mechanism and a combination of such a cable assembly in a housing

BACKGROUND OF THE INVENTION

Many electrical systems require cables to be attached to electronic or electrical components within a casing or housing containing the components and then emerge from an opening in the housing. Such cables can carry, for example, electrical signals from electrical circuits in one housing to circuits in another housing. Such cables are often subject to lateral and longitudinal stresses and strains which, if they are severe, may pull the cable out of the housing and detach it from the electrical or electronic component, leading to failure of the system.

A number of prior art constructions have been developed in order to protect the systems. For example, U.S. Pat. No. 4,900,266 (Sainsbury et al), assigned to GSI Corporation, teaches a cable and connector assembly in which a pair of strain-bearing cables are embedded in and extended longitudinally along the side edges of a ribbon cable. A circuit board member is formed with two passages which serve to receive a free end of the strain-bearing cables. The free ends of the strain-bearing cables are threaded through the passages and are bonded by means of an adhesive or the like to the circuit board member. The free ends may also be tied in a knot after being threaded through the passages so that the free ends are held fast with respect to the circuit board member. The assembly of this disclosure thus requires additional passages to be constructed in the circuit board member to accept the free ends of the strain-bearing cables. The circuit board member of this disclosure fulfills two roles. It serves to accept the conductors from the cable at connection points, and furthermore it acts as an anchoring element for the strain-bearing cables.

In a similar approach it is known in the art to attach strain-bearing cables to a circuit board member by means of a screw or post attached to the circuit board, around which are tied the ends of the strain-bearing cables.

Another approach to strain relief mechanisms is taught in U.S. Pat. No. 5,414,218 (Nathan) assigned to Alfred Karcher, GmbH & Co., in which a recess is formed between a double walled housing. A cable tensile strain reliever consists of a sheath and a clamping part. The clamping part is placed on the cable and thus constricts the cable, pressing the individual wires within the cable against the insulation of the cable. The sheath is provided with two annular grooves which are so designed that they fit into recesses in the two walls of the double walled housing such that a mechanically stable connection is ensured between the housing and the cable tensile strain reliever. Since the clamping part is constricted against the insulation of the cable, the external tensile forces can no longer be transferred to the connection points in the interior of the apparatus via the individual wires, but are transferred via the insulation of the cable to the clamping part and from there via the sheath to the housing. The cable tensile strain reliever of this disclosure thus requires both the design of the housing and the design of the sheath to be optimised with each other to ensure maximum protection.

The same Nathan '218 patent teaches a second embodiment in which a cable tensile strain reliever can be used with a single-walled housing. In this embodiment, the sheath is provided with a flange-like extension which is disposed within the housing. In this position, the extension transfers to the housing tensile forces which are exerted on the cable tensile strain reliever and directed towards the interior of the housing.

In the embodiments of the Nathan '218 patent, the sheath is made of an elastic plastic material such a polyvinyl chloride, polyurethane or a mixture of these two substances, or of a rubber material which is vulcanized onto the cable.

U.S. Pat. No. 4,857,674 (Filbert), assigned to Leviton Manufacturing Company, discloses a strain relief mechanism similar to the second embodiment of the Nathan '281 patent, in which a strain relief device made of a flexible material such as hard rubber carries a cable 14 running through a conduit in its body. The strain relief devices has two flanges mounted on one end which can be inserted through a hole in a casing or housing. The strain relief device is locked in place through rotation.

Clamps as strain relief mechanisms are also known in the art. U.S. Pat. No. 5,742,982 (Dodd et al.) teaches one such clamp assembly for one or more cables which is made in two clamp halves connected together by a hinge pin. One clamp half includes a pair of countersunk apertures to attach the clamp half to a fixed structure from which the cable or cables will be supported. The cables to be strain relieved enter into cavities within the clamp assembly and two clamp halves closed on each other. A nut tightens the clamp onto the cables therein to hold the cables tightly within the clamp assembly.

Another type of clamp is known from U.S. Pat. No. 4,758,179 (Klein et al), assigned to the Zippertubing Company, in which the housing has a sub-assembly through which an electrical cable passes before entering the housing. The sub-assembly has a pair of identical elongated metallic clamping members formed along their adjacent sides and which have sharp edge projections. On closure of the sub-assembly, the clamping members are tightened, causing the sharp edged projections of these members to bite into and form a strong anchorage with the jacket.

U.S. Pat. No. 5,980,298 (Johnson), assigned to National Instruments Corporation, teaches a further form of a strain-relief device which comprises a clamping portion including a fastener. The clamping portion has a slot through which a cable, such as a ribbon cable, can be passed and clamped in position. The fastener is used to releasably attach the clamping device to an electrical device housing.

Another older type of claim is known from U.S. Pat. No. 3,258,234 (Fernberg) assigned to United-Carr Inc. in which a cable passes through a fastener comprising a stud and an insert. The cable is inserted into the stud and then into an aperture of a support panel. The insert is brought up to the stud and pressed firmly home onto the stud so as to trap the cable securely in the stud. In the final position the cable is held securely in the support panel by virtue of the right-angled bend in the cable and the grip obtained on the cable between the insert and the shank of the stud. Any strain or pull on the cable on the other side of the panel is transmitted only to a substantially reduced extent.

From U.S. Pat. No. 5,975,924 (Daoud), assigned to Lucent Technologies, a strain relief mechanism is known which uses a conductive sleeve inserted into one end of a multi-line phone cable. The conductive sleeve has a threaded stud attached which is used to secure the conductive sleeve and hence also the phone cable into a conductive bracket.

SUMMARY OF THE INVENTION

An object of the invention is to improve the strain-relief mechanisms of cable assemblies.

A further object of the invention is to simplify the manufacture of cable assemblies incorporating strain relief mechanisms.

Yet a further object of the invention is to reduce the manufacturing time for electronic devices using cable assemblies with strain relief mechanisms.

These and other objects of the invention are solved by providing a cable assembly with a cable having a plurality of conductors and a strength member with member ends disposed in the cable assembly. At least one independent anchoring element is attached to at least one of the ends of the strength member and has an opening provided therein. The member end of the strength member passes through the opening of the anchoring element. The independent anchoring element is separate from the printed circuit board to which the plurality of conductors are connected and also from the housing or casing in which the printed circuit board is disposed. Thus neither the housing nor the printed circuit board have to be specially designed with anchoring points to accept the strength member. Furthermore, large stresses placed on the cable and hence on the anchoring member will not lead to potential destruction of a costly printed circuit board.

In a preferred embodiment of the cable assembly the opening is in the form of an eyehole disposed within the anchoring element. In this embodiment, the strength element cannot slip out of the opening, since it is enclosed on all sides by the anchoring element. A particularly advantageous embodiment of the invention uses a cable shoe with an eyehole disposed therein. This is a standard part which is available freely and is consequently cheap.

The cable assembly can also be provided with a cable sleeve attached to at the least one end of the cable. This cable sleeve provides stability and rigidity to the ends of the cable and thus allows the lateral and longitudinal stresses to be transmitted to the casing or housing into which the conductors of the cable assembly enter.

The cable sleeve is most advantageously provided with a fixing lip into which the walls of the casing can slot, and the cable assembly is thus held in position. The eye of the cable shoe is disposed at the end of the cable sleeve and thus, when logitudinal forces are exterted on the strength member, the cable shoe is pulled against the end of the cable sleeve.

The object of the invention is also solved by providing a combination of a casing and a cable assembly attached to the casing. The cable assembly has a cable with a plurality of conductors and a strength member with member ends disposed within the cable assembly. At least one anchoring element is attached to one of the ends of the strength member. The anchoring element is disposed within the casing and has an opening through which the strength member passes. Thus, when longitudinal or lateral stress or strain is applied to the cable assembly, the anchoring element is pulled against the wall of the casing to which the stresses are transferred.

DETAILED DESCRIPTION OF THE INVENTION

Figure 1:
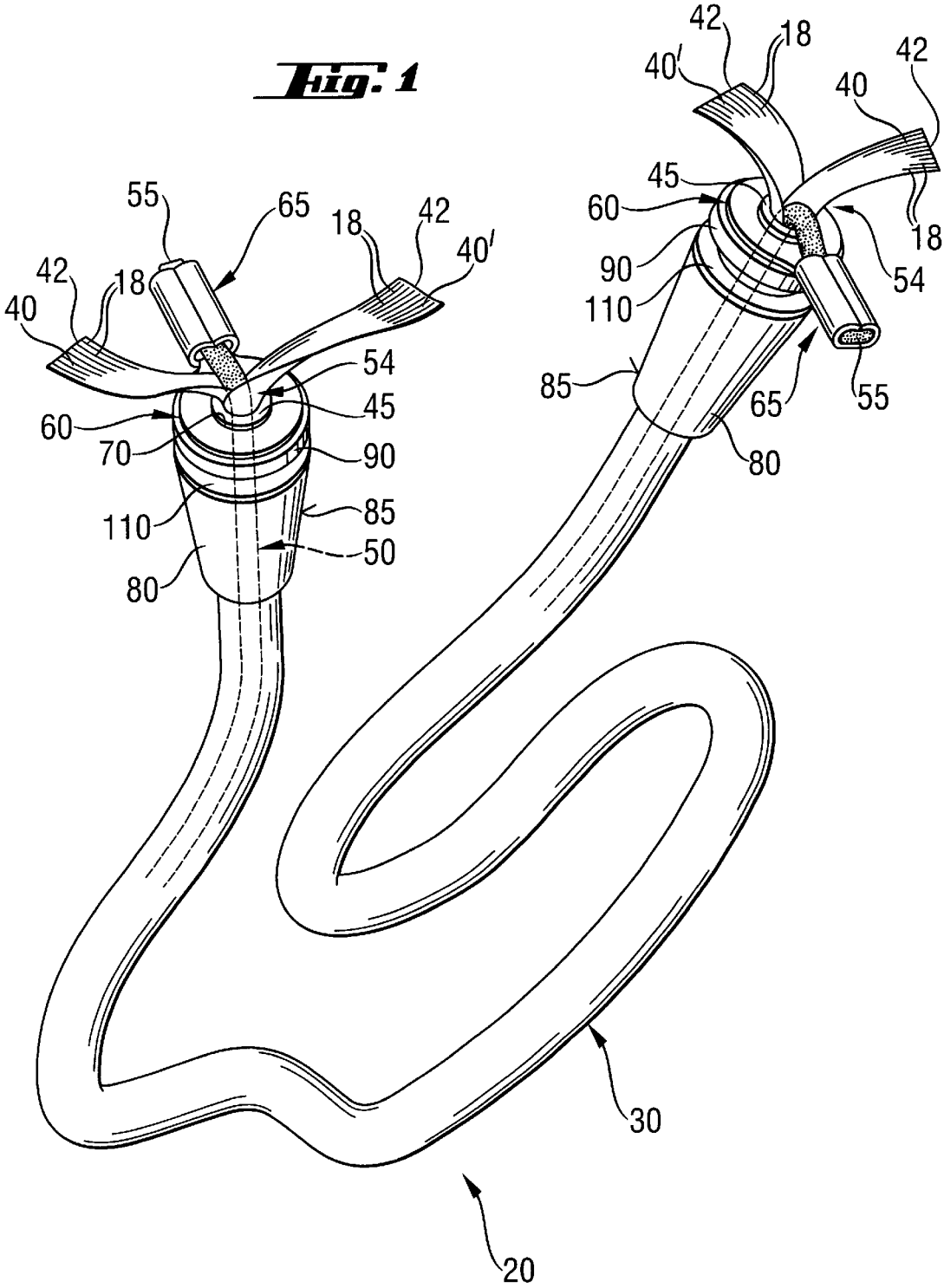
FIG. 1 shows a perspective view of the cable assembly incorporating the strain relief mechanism of the invention.
Figure 3:
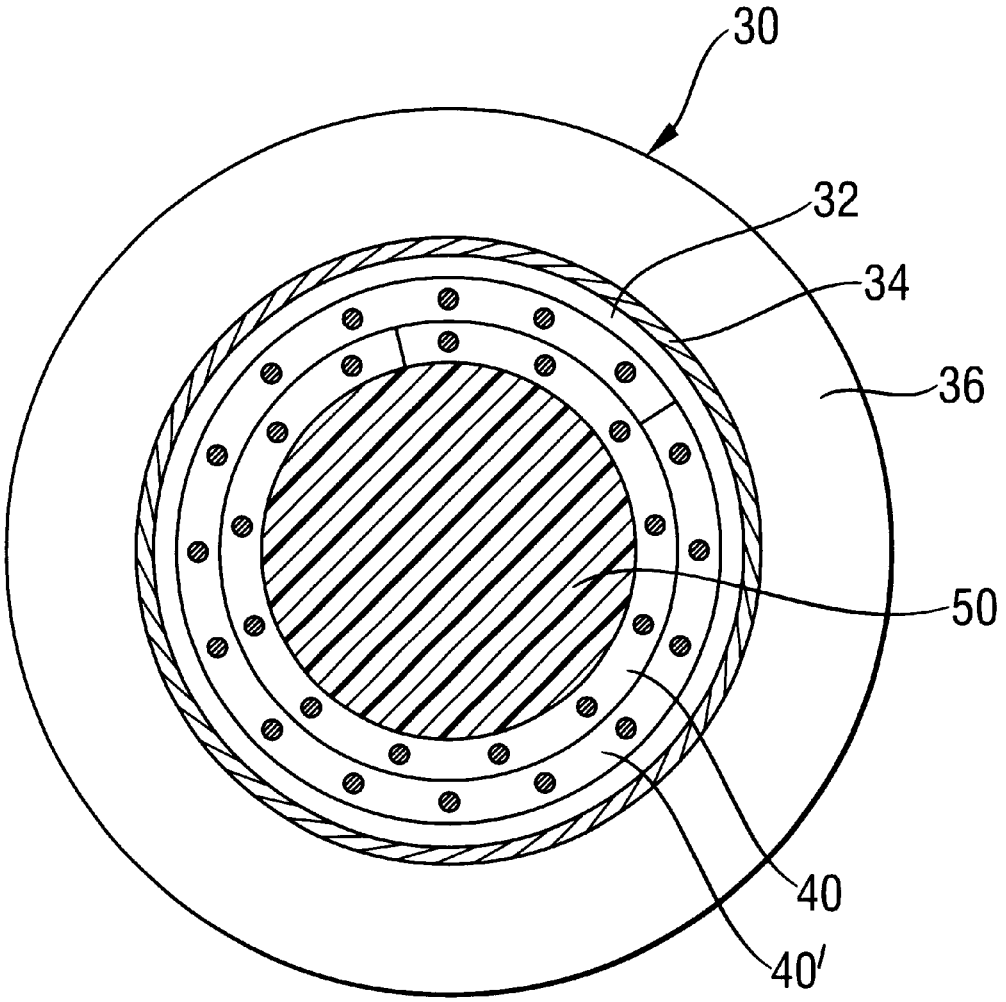
FIG. 3 shows a cross-section of the cable.

FIG. 1 shows a cable assembly 20 with a cable 30 and the strain relief mechanism of the invention. A cross-section of the cable 30 is shown in FIG. 3.

The cable 30 has a central strength member 50, about which are concentrically wrapped two ribbon cables 40 and 40'. A binder 32 is wrapped about the outer one 40' of the two ribbon cables and a shield 34 placed about the binder 32. A jacket 36 is disposed about the shield 34.

The strength member 50 can be made of any material having a high longitudinal tensile strength. Examples include polyamide, para-aramid or polytetrafluoroethylene fibers which may be woven or braided together. The two ribbon cables 40 and 40' are known in the prior art. They may consist, for example, of electrical conductors 42 laminated between two layers of a dielectric material or electrical conductors extruded within dielectric material. The binder 32 is made of a dielectric material known in the art. The jacket 36 is extruded or wrapped about the binder 32 and is made of an insulating material known in the art.

Although the invention is described in connection with the use of ribbon cables, the strain relief mechanism which is described below is equally applicable for use in electrical cables in which individual conductors such as micro-coaxial conductors are disposed within a jacket 36 or a loose tube. The strength member 50 is also arranged within the jacket 36 or tube.

As can be seen from FIG. 1, a cable sleeve 80 is arranged about the jacket 36 at least one of the ends 45 of the cable 30. The cable sleeve 80 is made from a plastic material such as polyurethane or polyvinylchloride and is extruded over the jacket 36. The cable sleeve 80 is conically-shaped and has at its base 85 nearest the cable end 45 a fixing groove 110 and a fixing lip 90 as can be seen from FIG. 1. The fixing groove 110 and the fixing lip 90 co-operate with the housing 10 or casing of an electrical device to secure the cable 30, as will be explained later.

The ribbon cables 40 and 40', as well as the strength member 50, emerge from the end 54 of the cable 30 through an eyehole 70 of an anchoring element 60. The anchoring element 60 is constructed in one embodiment of the invention in the form of a disc with a centrally positioned eyehole 70 and having a extension 65 extending from the periphery of the disc. The extension 65 is used in one embodiment of the invention 65 to crimp an end 55 of the strength member 50 and thus attach the strength member 50 to the anchoring element 60. In a preferred form of the invention, the anchoring element 60 is in the form of a cable shoe. However, other constructions can be used in which the strength member 50 is securely attached to the anchoring element 60. For example, a washer could be used as an anchoring element 60, and the strength member 50 could be welded or adhered to the rim of the washer.

Figure 2:
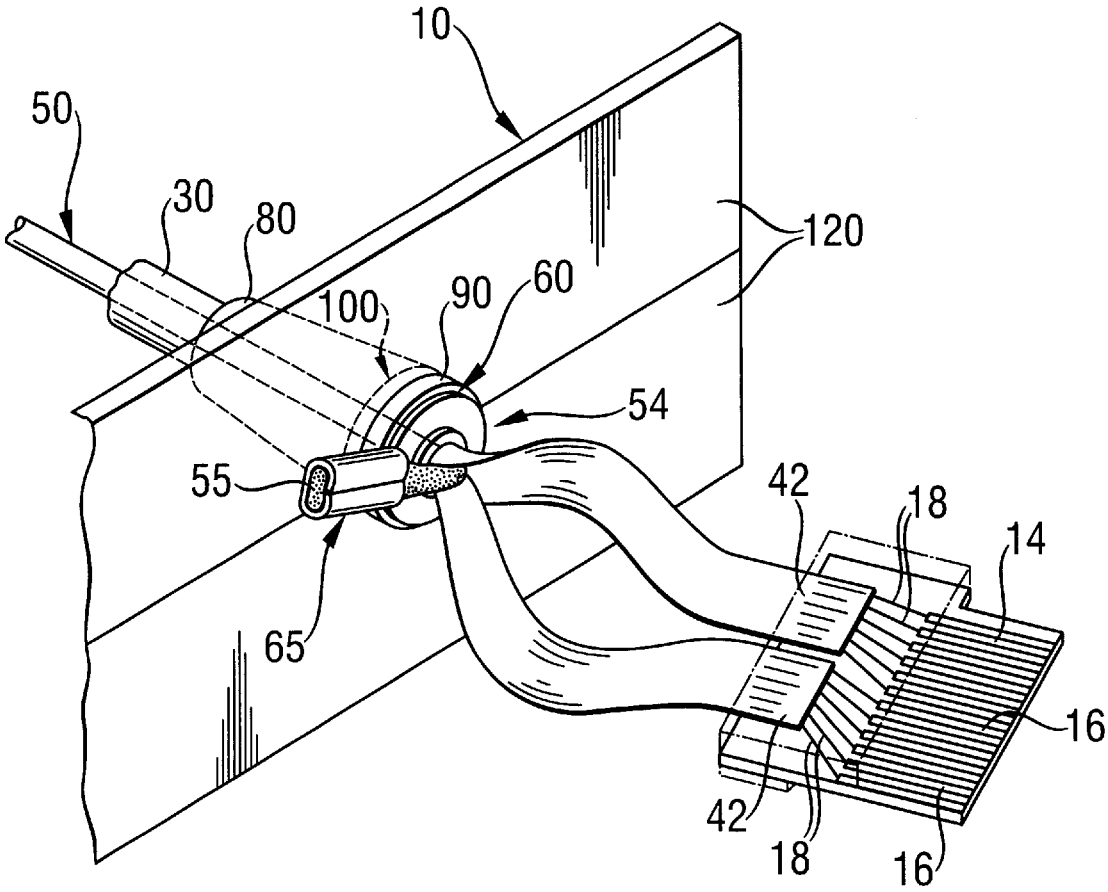
FIG. 2 shows the cable assembly with the strain relief mechanism incorporated in a housing.

FIG. 2 shows an example of the cable 30 with the strain relief mechanism in use in a housing 10 of an electronic gadget. The housing 10 has a housing opening 100 in a wall 120 of the housing 10, through which electrical connection is to be made between the ribbon cables 40, 40' of the cable 30 and a printed circuit board 14 or other electronic devices within the housing 10. The conductors 42 within the ribbon cables 40, 40' are connected to tracks 16 on the printed circuit board 14 at connection points 18. The dimensions of the housing opening 100 and the cable sleeve 80 are chosen such that the wall 120 of the housing 10 fits within the fixing groove 110 and the fixing lip 90 is placed within the housing 10 and cannot slip through the housing opening 100.

In operation, the strain relief mechanism works as follows. Any lateral or longitudinal strain placed on the cable 30 is transferred substantially to the strength member 50 within the cable assembly 20. The strength member 50 is attached to the anchoring element 60. Thus the strain is transferred to the anchoring element 60. The effect of the strain is to try and pull the anchoring element 60 out of the housing 10. The anchoring element 60 is, however, restrained by the fixing lip 90 which is, as a result, compressed between the anchoring element 60 and the wall 120 of the housing 10. Thus the anchoring element 60 cannot be pulled out of the housing 10 and, as a result, the cable 30 cannot be pulled out of the housing 10.

EXAMPLES

An example of the invention was made using a cable 30 of approx. 4.0 mm diameter and having a strength member 50 of approx. 1.7 mm diameter being made of woven para-aramid fibers impregnated with polyurethane. The ribbon cables 40 and 40' are made in this example of silver-plated conductors of AWG 42 (0.063 mm diameter) laminated between two expanded polytetrafluoroethylene (ePTFE) tapes of 0.1 mm thickness. The inner one 40 of the ribbon cables had thirteen conductors and the outer one 40' of the ribbon cables had sixteen cables. The pitch between the conductors is 0.35 mm. The binder 32 was made of two ePTFE tapes of thickness 5 $\mu$m, wrapped in opposite directions to the ribbon cables 40 and 40'. The shield 34 is made of braided tinned copper wire of AWG 40, and the jacket of extruded polyvinylchloride.

TESTS

Figure 4:
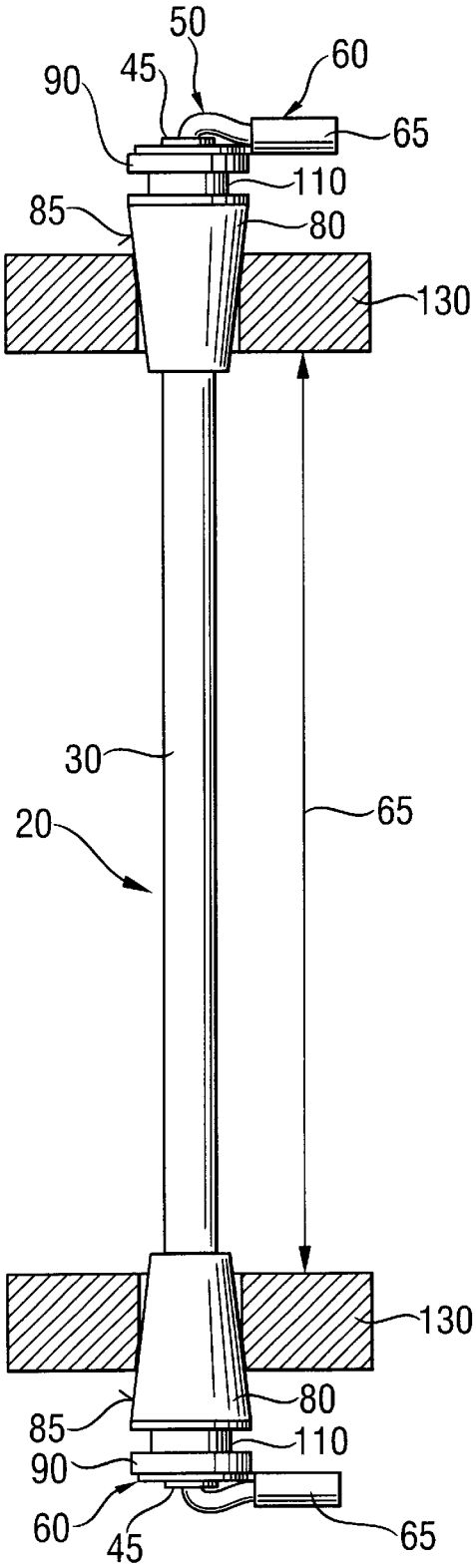
FIG. 4 shows a first test assembly of the cable assembly of the invention.

Two tests were carried out on a cable assembly 20 of 200 mm length of cable 30 on which cable sleeves 85 had been attached to both cable ends 45. In the first test, shown in FIG. 4, the cable sleeves were gripped by grips 130 and a force applied between the two grips 130. Five samples were tested and the two grips 130 were separated at a speed of 25 mm/min. The weakest part of the cable assembly 20 was the attachment by crimping of the strength member 50 to the extension 65. Table 1 shows the results of the test with maximum lateral tension and the elongation of the cable assembly 20 at the maximum tension.

TABLE 1

| Sample No. | Maximum Tension (N) | Elongation at Max. Tension (%) |
|---|---|---|
| 1 | 100.6 | 21.0 |
| 2 | 111.5 | 18.3 |
| 3 | 113.4 | 18.6 |
| 4 | 90.5 | 17.9 |
| 5 | 100.3 | 20.1 |

Figure 5:
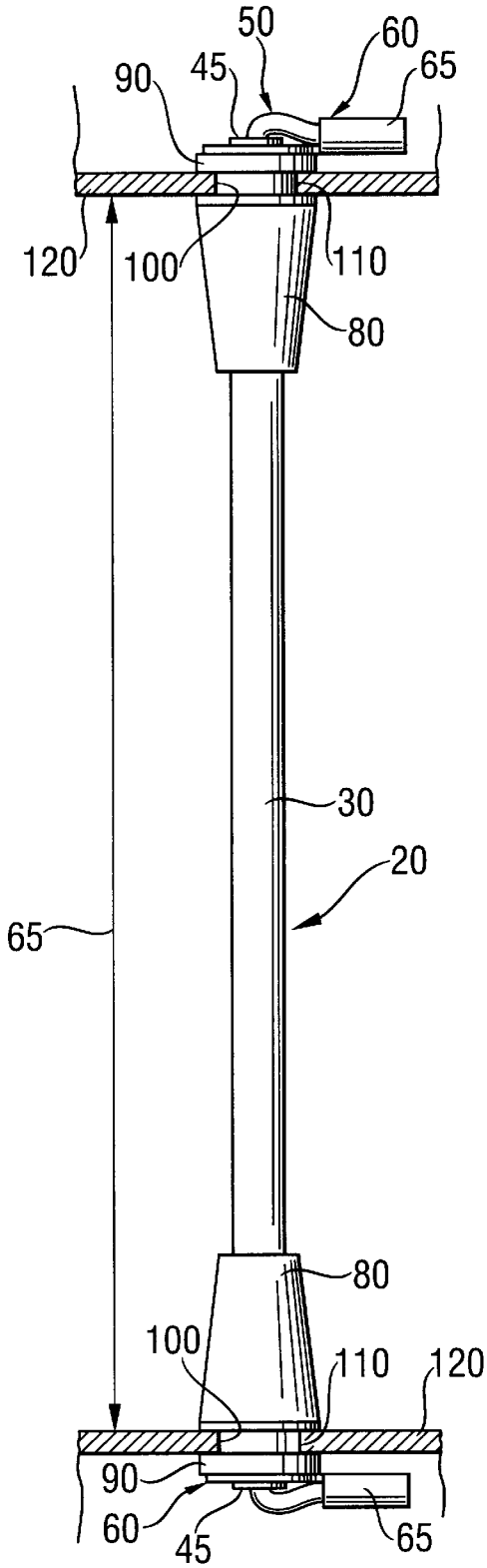
FIG. 5 shows a second test assembly of the cable assembly of the invention.

In the second test, shown in FIG. 5, the cable assembly 20 was attached to two housings 10 similar to those depicted in FIG. 2. In this case the weakest part of the system is the interface between the housing 10 and the cable assembly 20, in particular the cable sleeve 85, and the mechanical robustness of the housing 10 itself.

Five samples were tested and in all cases the maximum tension applied was 25N which the housing 10 and cable assembly were able to withstand.

What is claimed is:

1. A cable assembly having a cable extending along the cable assembly, a strength member with member ends extending along the cable assembly;

at least one independent anchoring element, attached to one of the member ends and having an opening provided therein; whereby the strength member passes through the opening of the independent anchoring element.

2. The cable assembly of claim 1 whereby the opening is in the form of an eyehole disposed within the independent anchoring element.

3. The cable assembly of claim 1 wherein the independent anchoring element is a cable shoe with an eyehole disposed therein.

4. The cable assembly of claim 1 further comprising a cable sleeve attached at the least one end of the cable.

5. The cable assembly of claim 4 wherein the cable sleeve has a fixing lip.

6. The cable assembly of claim 4 in which the eye of the cable shoe is disposed at the end of the cable sleeve.

7. The cable assembly of claim 1 having a breaking strength of over 80N.

8. The cable assembly of claim 1 wherein strength member is a polyurethane coated para-aramide fiber.

9. The cable assembly of claim 1 whereby the anchoring element is crimped to the strength member.

10. The combination of a casing and a cable assembly attached to the casing comprising:

a strength member with ends disposed in the cable;

at least one independent anchoring element, attached to one of the ends of the strength member, disposed within the casing and having an opening therein; whereby the strength member passes through the opening of the independent anchoring element.

11. The combination of claim 10 whereby the opening is in the form of an eyehole disposed within the independent anchoring element.

12. The combination of claim 10 wherein the anchoring element is a cable shoe with an eyehole disposed therein.

13. The combination of claim 10 further comprising a cable sleeve attached at least one end of the cable.

14. The combination of claim 13 wherein the cable sleeve has a fixing lip which is disposed inside of the casing and a fixing groove in which is disposed a wall of the casing.

15. The combination of claim 13 in which the opening of the independent anchoring element is disposed at the end of the cable sleeve such that the fixing lip is placed between a wall of the casing and the opening of the independent anchoring element.

16. The combination of claim 10 having a breaking strength of over 25N.

17. The combination of claim 10 wherein the strength member is a polyurethane coated para-aramide fiber.

18. The combination of claim 10 wherein the independent anchoring element is crimped to the strength member.

* * * * *